US005678129A

United States Patent [19]

Yasuda et al.

[11] Patent Number: 5,678,129

[45] Date of Patent: Oct. 14, 1997

[54] IMAGE FORMING APPARATUS WITH CONTACT TYPE CHARGING MEMBER

[75] Inventors: Wataru Yasuda, Tokyo; Shinsuke Kikui, Yokohama; Naomi Sugimoto, Kawasaki, all of Japan

[73] Assignee: Ricoh Company, Ltd., Tokyo, Japan

[21] Appl. No.: 536,216

[22] Filed: Sep. 29, 1995

[30] Foreign Application Priority Data

Sep. 29, 1994 [JP] Japan ..... 6-234579
Oct. 6, 1994 [JP] Japan ..... 6-243103

[51] Int. Cl.[6] ..... G03G 15/02

[52] U.S. Cl. ..... 399/50; 219/497; 361/225; 399/176

[58] Field of Search ..... 355/219, 204, 355/207, 208, 246, 214, 205; 361/225; 219/494, 497, 216, 505; 399/50, 176

[56] References Cited

U.S. PATENT DOCUMENTS

| | | | |
|---|---|---|---|
| 5,038,175 | 8/1991 | Sohmiya et al. | 355/246 |
| 5,365,318 | 11/1994 | Hiraoka et al. | 355/246 |
| 5,479,243 | 12/1995 | Kurokawa et al. | 355/219 |
| 5,483,323 | 1/1996 | Matsuda et al. | 355/219 |

FOREIGN PATENT DOCUMENTS

| | | |
|---|---|---|
| 4-186381 | 7/1992 | Japan . |
| 5 181350 | 7/1993 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An image forming apparatus includes a charging member to be contacted with a rotating photosensitive body so as to charge the photosensitive body, a temperature detection device for detecting temperature of the charging member, and a voltage control device for controlling a voltage to be supplied to the charging member in accordance with a temperature value detected by the temperature detection device. The control device includes a detection temperature read device for reading the detection temperature value detected by the temperature detection device, a voltage calculation device for calculating a voltage to be supplied to the charging member based on the detection temperature value read by the detection temperature read device, and a maintenance device for maintaining a charging voltage as it is, which charging voltage is calculated last time, when a difference between the detection temperature value currently read by the detection temperature read device and the detection temperature value which is read last time by the detection temperature read device has exceeded a preset temperature value.

26 Claims, 10 Drawing Sheets

FIG. 3
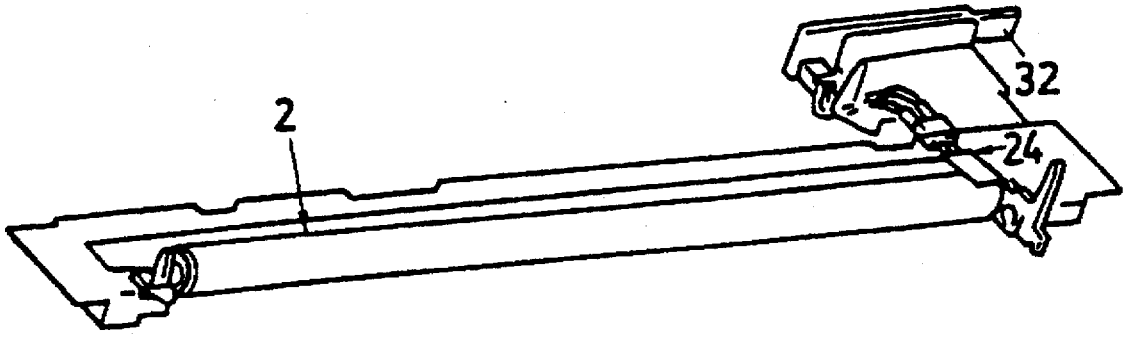
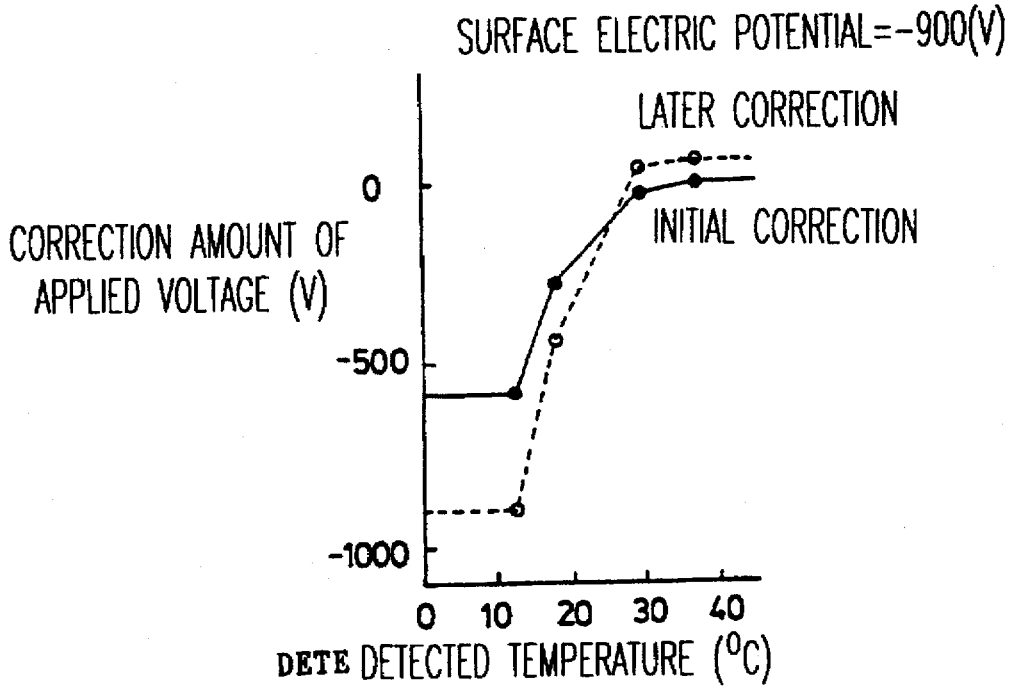
FIG. 4

IMAGE FORMING APPARATUS WITH CONTACT TYPE CHARGING MEMBER

BACKGROUND OF THE INVENTION

This invention relates to an electrophotographic type image forming apparatus such as a laser printer, a copying machine, a facsimile machine and the like. More particularly, it relates to an image forming apparatus for charging the surface of a photosensitive body by means of physical contact of a charging member thereto.

There is known an image forming apparatus, in which the surface of a drum-like (or belt-like) photosensitive body is uniformly charged by a charging member, an electrostatic latent image is then formed thereon by exposure, the electrostatic latent image is then adhered with a toner by a developing roller so as to be visualized as a toner image, the toner image is then transferred to a transfer paper, and the toner image fixed to the transfer paper to form an image on the transfer paper. In order to charge the photosensitive body uniformly, heretofore, a corona discharge system is employed as the charging member.

However, since the charging member of this corona discharge system is in non-contact relation with respect to the photosensitive body and the photosensitive body is charged by ionizing a discharge space, a large amount of ozone is produced. The ozone is produced much more when a minus discharge is made. Recently, as the use of a minus discharging organic photosensitive body as the photosensitive body is increased, the generation of ozone appears to be a more serious problem. Also, it gives rise to such a problem that nitrogen compounds (NOx), etc., which are by-products produced by ozone, are adhered to the photosensitive body to cause an uneven charging. In view of the foregoing, recently, there is developed a contact-to-charge type image forming apparatus in which a charging roller as the charging member is brought into contact with a photosensitive layer on the surface of the photosensitive body so as to charge the surface thereof. According to this image forming apparatus, the supply voltage to be supplied to the charging member can be lowered compared with the corona discharge system, and the amount of generation of ozone can be drastically reduced.

A rubber, which is excellent is environmental safeness, such as, for example, an epichlorohydrine rubber (see, for example, official gazette of Japanese Laid-Open Patent Application No. Hei 1-277257), is employed as a resistance layer of this contact type charging roller. The epichlorohydrine rubber used here has a middle resistance (for example, about $10^8$ Ω) taking into consideration of the prevention of any leak to a defective layer on the photosensitive body. The epichlorohydrine rubber has the advantage that there are comparatively small irregularities among the lots. On the other hand, it has the disadvantage that variation of resistance against temperature is large. For this reason, a charging roller of this type is readily affected by environmental temperature and the charge on the surface of the photosensitive body tends to be uneven. That is, the resistance layer of this type of charging roller is readily affected by temperature. For example, under the circumstance of low temperature, the resistance is increased and the dielectric constant is decreased. As a consequence, the impedance of the charging roller is decreased and an inferior charging occurs. Depending on the circumstance for use, electrical characteristics of the charging member such as value of resistance, dielectric constant and the like are changed. This can be the cause of the uneven charging. In an image forming apparatus disclosed in an official gazette of Japanese Laid-Open Patent Application No. Hei 1-284872, a heated air by a hot fixing device or the like is sent through a longitudinal air passage of a charging roller using a ventilation fan, so that the temperature of the charging roller is maintained generally at a predetermined level and a constant volume resistance factor of the charging roller is maintained. However, in case of an image forming apparatus having the construction that the temperature of the charging roller is maintained at a predetermined level by sending a heated air to the charging roller, the number of component parts is increased. In addition, because of a provision of a duct for forming the air passage, etc., the image forming apparatus itself becomes large in size.

In view of the above, it can be contemplated, for example, that the surface temperature of the charging roller is measured using a temperature detection means (temperature sensor) such as a thermistor or the like, and a supply voltage to be supplied to the charging roller is controlled in accordance with the measured temperature, thereby preventing uneven charging (see, for example, official gazette of Japanese Laid-Open Patent Application No. Hei 4186381). In this case, in order to detect the temperature of the charging roller correctly, a temperature is disposed in the vicinity (or on the surface) of the charging roller in contact relation. This temperature sensor is a part having a long service life, whereas the charging member, photosensitive body, etc. are articles of consumption. The charging member, photosensitive body, etc. must be removed from the body for replacement after the passage of a predetermined time. For this reason, it is difficult to design such that the temperature sensor is disposed on the apparatus body taking into consideration of attachability/detachability of the charging member, photosensitive body, etc. with respect to the apparatus body. Moreover, there is a tendency that the charging member and temperature sensor are made into a unit type construction in order to miniaturize the image forming apparatus and to enhance maintenance. It is a usual practice that a voltage control means is loaded on the apparatus body. Therefore, in order to realize the above-mentioned unit type construction, a provision of an electric connection terminal is necessary at least at one location between the temperature sensor and the apparatus body. For the unit type construction, for example, the temperature sensor is attached to a print board, a connector having a connecting wire is disposed on the apparatus body, and the temperature sensor is electrically connected to the voltage control means of the apparatus body through the connector.

In case the construction for electrically connecting the temperature sensor to the voltage control means of the apparatus body through the connector is employed, resistance noise occurs between contact points of adjacent contacts because mechanical vibrations occur due to rotation of the photosensitive body, rotation of various carrier rollers, and actuation of clutches, etc., during the operation of the image forming apparatus. As a consequence, it sometimes happens that a different temperature data from the actual temperature data output by the temperature sensor are input to the voltage control means of the apparatus body. Therefore, the voltage control means controls the supply voltage to be supplied to the charging member based on the different temperature data from the actual temperature data. As a result, it sometimes happens that an appropriate supply voltage controlling is not made due to generation of noise caused by the mechanical vibrations. Particularly, when this noise occurs during a continuous formation (for example, repeat copy) of an image by a copying machine, it happens such an undesirable situation that density of an image formed on one transfer paper is extremely different from that of an image formed on another transfer paper during tire time the same original image is being copied. Also, if the electrical connection of the temperature sensor to the voltage control means of the apparatus body through the connector is imperfect, there is a fear that an incorrect detection occurs because the sensor output of the temperature sensor cannot be input to the voltage control means of the apparatus body in a normal condition. Further, a severe wiring arrangement due to a smaller design of the apparatus causes a wire-cut at a bent portion of the connecting wire, which results in formation of a short circuit in a rare case. As a result, the temperature data output by the temperature sensor sometimes shows an abnormal value.

For example, the temperature sensor usually detects the surface temperature of the charging roller within a range of from 0° C. to 100° C. The voltage control means makes a correction in this temperature range and controls the supply voltage to be supplied to the charging roller. When the surface temperature of the charging roller is not within the temperature range, when the temperature of the charging roller is, for example, 0° C. or lower, the voltage control means supplies a supply voltage intended for the temperature of 0° C. to the charging roller, and when the temperature of the charging roller is 100° C. or higher, the voltage control means supplies a supply voltage intended for the temperature of 100° C. to the charging roller. When the temperature is low, the supply voltage to be supplied to the charging roller is larger toward the minus side, and when the temperature is high, comparatively small toward the minus side. Therefore, when the temperature data output by the temperature sensor is low, a comparatively high voltage is supplied to the charging roller.

When an inferior connection of the connector, or a wire-cut of the wiring occurs, the temperature data output from the temperature sensor is 0° C. because the thermistor has a negative resistance characteristic. When a short circuit is occurred, the temperature data output from the temperature sensor is 100° C. Since the voltage control means controls the supply voltage to be supplied to the charging roller based on that temperature data, a different supply voltage from the supply voltage (for example, the supply voltage to be supplied to the charging roller at a so-called ordinary temperature (23° C.) is −1680 V) good for an actual surface temperature of the charging roller is supplied to the charging roller. As a consequence, it happens that a favorable image cannot be formed because the electric potential charged on the surface of the photosensitive body is extremely shifted from a correct electric potential. Particularly, when an inferior connection of the connector or a short circuit of the wiring occurs, a supply voltage intended for 0° C. is supplied to the charging roller. Since this supply voltage is so high that it almost reaches the level of the breakdown voltage of the charging roller and photosensitive body, it is not desirable that such a high voltage is supplied to the charging roller due to the above-mentioned incorrect detection. It should be noted that the unit type is obtained by integrating the charging member, temperature sensor and photosensitive body.

Among many types of image forming apparatus such as copying machine, there is one which employs a two component developing device using carrier and toner. In this type of an image forming apparatus, a P-pattern portion for detecting the density of toner is formed on a predetermined location of the surface of the photosensitive body, for example. In this image forming apparatus, the surface electric potential of the photosensitive body is maintained to a predetermined electric potential (an electric potential equal to optimum electric potential (for example, −900 V) or an electric potential lower (for example, −800 V) than the optimum electric potential and in that state, the toner is adhered to the P-pattern portion. Toner is supplied from the toner supply tank to the developing tank so that the amount of toner adhered to the P-pattern portion is always constant. By this arrangement, the amount of the supply of toner to the developing tank is controlled. In this case, when the inferior contact of the connector of the temperature sensor, wire-cut of the wiring, short circuit, or the like occurs, the supply voltage to be supplied to the charging roller in order to charge the photosensitive body to a predetermined level is corrected by mistake and the surface electric potential of the photosensitive body is shifted from the predetermined electric potential. As a consequence, the amount of toner adhered to the P-pattern portion is changed. Consequently, a normal toner supply cannot be made. Also in this case, it gives rise to the problem that an image of a normal density cannot be obtained.

SUMMARY OF THE INVENTION

A first object of the present invention is to provide an image forming apparatus, in which there can be avoided such a situation where an appropriate supply voltage controlling cannot be made due to generation of noise caused by mechanical vibrations, thus enabling to obtain a stable image quality.

A second object of the present invention is to provide an image forming apparatus, in which deterioration of an image quality can be avoided as much as possible when an abnormal situation occurs caused by inferior connection of a temperature detection means for detection the surface temperature of a charting member, wire-cut at an intermediate part of the wiring, and short circuit.

In order to achieve the first object, an image forming apparatus according to the first invention comprises a charging member to be contacted with a rotating photosensitive body so as to charge the photosensitive body, temperature detection means for detecting temperature of the charging member, and voltage control means for controlling a voltage to be supplied to the charging member in accordance with a temperature value detected by the temperature detection means, the voltage control means including detection temperature read means for reading the detection temperature value detected by the temperature detection means voltage calculation means for calculating a voltage to be supplied to the charging member based on the detection temperature value read by the detection temperature read means, and maintenance means for maintaining a charging voltage as it is, which charging voltage is calculated last time, when a difference between the detection temperature value currently read by the detection temperature read means and the detection temperature value which is read last time by the detection temperature read means has exceeded a preset temperature value. By virtue of this arrangement, fluctuation of the electric potential charged to the surface of the photosensitive body can be prevented even if a detection temperature data is subjected to noise. Preferably, the voltage control means includes a voltage switch means for switching the charging voltage obtained based on the result of calculation achieved by the voltage calculation means at a predetermined timing, so that the supply voltage to be supplied to the charging member is not changed during rotation of the photosensitive body which rotation is made for obtaining an electrostatic latent image to be formed on a sheet of paper. By virtue of this arrangement, there can be avoided an uneven image which would, otherwise, be occurrable to an original image formed on a transfer paper when a supply voltage is switched during a midway of a process for forming an image on a single transfer paper. More preferably, the voltage calculation means calculates a supply voltage to be supplied to the charging member based on a predetermined fixed temperature value when the detection temperature value is not within a predetermined temperature range. By virtue of this arrangement, it becomes possible to form an image as an emergency measure when a wire-cut at a connecting portion between the temperature detection means and the voltage control means, a short circuit, etc. should have occurred. It is desirable that the voltage control means supplies the supply voltage newly calculated by the voltage calculation means to the charging member at the above-mentioned timing when an image is successively formed on plural sheets of paper. It is more desirable that the voltage control means supplies the supply voltage, which was calculated last time, to the charging member when a difference between the supply voltage newly calculated by the voltage calculation means this time and the supply voltage calculated by the voltage calculation means last time exceeds a preset voltage value. By virtue of this arrangement, fluctuation of an image to be transferred to the transfer paper can be minimized.

In order to achieve the second object, an image forming apparatus according to the second invention comprises a charging member to be contacted with a rotating photosensitive body so as to charge the photosensitive body, temperature detection means for detecting temperature of the charging member, and voltage control means for controlling a voltage to be supplied to the charging member in accordance with a temperature value detected by the temperature detection means, the voltage control means including detection temperature read means for reading the detection temperature value detected by the temperature detection means, voltage calculation means for calculating a voltage to be supplied to the charging member based on the detection temperature value read by the detection temperature read means, and maintenance means for maintaining a charging voltage as it is, which charging voltage is calculated last time, when a difference between the detection temperature value currently read by the detection temperature read means and the detection temperature value which is read last time by the detection temperature read means has exceeded a preset temperature value and the detection temperature value is within a predetermined temperature range. Preferably, the voltage control means includes a voltage switch means for switching the charging voltage obtained based on the result of calculation achieved by the voltage calculation means at a predetermined timing, so that the supply voltage to be supplied to the charging member is not changed during rotation of the photosensitive body which rotation is made for obtaining an electrostatic latent image to be formed on a sheet of paper. More preferably, the voltage calculation means calculates a supply voltage to be supplied to the charging member based on a predetermined fixed temperature value when the detection temperature value in not within a predetermined temperature range. It is desirable that the voltage control means supplies the supply voltage newly calculated by the voltage calculation means to the charging member at the above-mentioned timing when an image is successively formed on plural sheets of paper. It is more desirable that the voltage control means supplies the supply voltage, which was calculated last time, to the charging member when a difference between the supply voltage newly calculated by the voltage calculation means this time and the supply voltage calculated by the voltage calculation means last time exceeds a preset voltage value. It is preferred that the charging member is made chiefly of an epichlorohydrine rubber. It is also preferred that the detection temperature read means reads the detection temperature value at a predetermined time interval. The function and effect of the second invention is the same as that of the first invention.

An image forming apparatus according to the third invention comprises a charging member which can be brought into contact with and away from a photosensitive layer of a surface of a rotating photosensitive body and which charges the surface of the photosensitive body when the charging member is brought into contact with the photosensitive layer, temperature detection means for detecting temperature of the charging member, and voltage control means for controlling a supply voltage to be supplied to the charging member in accordance with the detection temperature detected by the temperature detection means so that a surface electric potential of the photosensitive body is maintained to a preset voltage value before being subjected to exposure for forming an electrostatic latent image, the voltage control means supplying a preset supply voltage to the charging member when the detection temperature value detected by the temperature detection means is not within a preset temperature range. According to this invention, deterioration of the quality of an image can be avoided as such as possible when an abnormal situation occurs due to inferior connection of the temperature detection means for detecting the surface temperature of the charging member, a wire-cut at an intermediate part of the wiring, and a short circuit. Preferably, the voltage control means supplies a supply voltage corresponding to the detection temperature value again to the charging member when the detection temperature value is changed from a value not within the preset temperature range to a value within a preset temperature range. When the cause of the abnormal detection has been removed, the controlling mode is returned to the original one and therefore, an easy maintenance can be obtained.

It is preferred that the image forming apparatus further comprises a two component developing device using a developer and a toner, and switch means for switching a control mode from a toner density adjustment control mode for changing a supply amount of toner in accordance with the toner density when the detection temperature value detected by the temperature detection means is not within the preset temperature range to a control mode for maintaining the toner density constant irrespective of toner density or to a control mode for controlling the supply amount of toner constant irrespective of toner density. According to this construction, deterioration of the quality or an image can also be prevented in a developing device of the two component developing system when an abnormal situation has occurred. It is more preferred that the voltage control means supplies a supply voltage corresponding to the detection temperature value again to the charging member when the detection temperature value is changed from a value outside the preset temperature range to a value within a preset temperature range, and the switch means switches a control mode again to the toner density adjustment control mode for changing a supply amount of toner in accordance with the toner density when the detection temperature value is changed from a value not within the preset temperature range to a value within the preset temperature range. Further, it is desirable that the voltage control means supplies a preset supply voltage to the charging member when the detection temperature value detected by the temperature detection means goes below a lower limit defining a boundary of the preset temperature range on a lower temperature side. Owing to this arrangement, a possible occurrence of breakdown voltage on the low temperature side can be avoided as much as possible. More preferably, the preset supply voltage is determined based on temperature which is normally used.

BRIEF DESCRIPTION OF THE DRAWINGS

FIG. 3 is a perspective view showing one example of a construction of a charging unit comprising a charging roller, a temperature detection portion, etc.

FIG. 4 is a graph showing a relation between a detection temperature detected by a temperature detection means and an amount of correction of a supply voltage to be supplied to the charging roller when the surface voltage of the photosensitive body of FIG. 1 is brought to −900 V.

DETAILED DESCRIPTION OF THE PREFERRED EMBODIMENTS

First Embodiment

Figure 1:
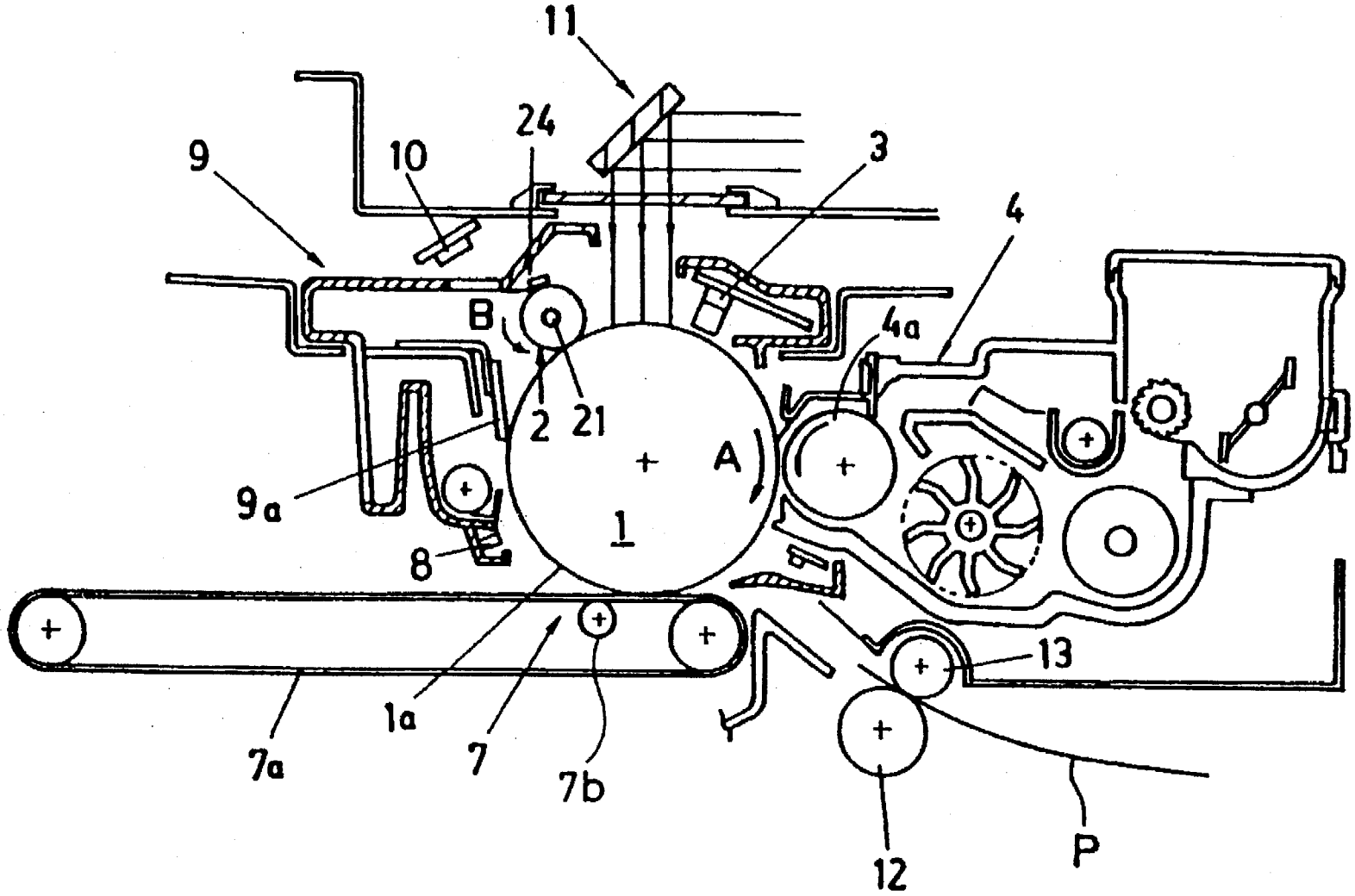
FIG. 1 is a schematic view of a general construction showing a drum and other parts therearound, of a copying machine according to a first embodiment of the prevent invention.

FIG. 1 is a schematic view showing a general construction of a drum and other parts therearound, of a copying machine according to a first embodiment of the present invention. This copying machine is of the contact-to-charge type in which a charging roller is brought directly into contact with a drum-like rotatable photosensitive body 1 and in that state, a preset voltage is supplied to a surface 1*a* of the photosensitive body 1 so that the surface 1*a* of the photosensitive body 1 is uniformly charged to a predetermined electric potential level. When the photosensitive roller 1 is rotated in a direction as indicated by an arrow A at a predetermined peripheral speed, the charging roller 2 is rotated in a direction as indicated by an arrow B at an equal speed in response to the rotation of the photosensitive body 1. The photosensitive body 1 is driven by a driving device comprising a drum driving timing belt, a pair of drum driving pulleys, a motor (not shown) for driving them, and some others. The charging roller 2 is normally in contact with the surface 1*a* under a predetermined pressure. Around the photosensitive body 1, there are arranged, in addition to the charging roller 2, an eraser 3, a developing device 4, a contact type transfer device 7 having an endless belt 7*a*, a P-sensor 8, a cleaning unit 9, and a quenching lamp 10. In an ordinary image forming process, the surface 1*a* of the photosensitive body 1 is charged to an appropriate electric potential (−900 V in this embodiment) level of the photosensitive body 1 by the charging roller 2. Thereafter, the charged surface is exposed by light irradiated from an exposure device 11 (only a mirror portion is shown) in accordance with an original image. By this, an electrostatic latent image is formed on the charged surface. The eraser 8 is adapted to erase a static electric charge in a region outside the size of a transfer paper P. As a consequence, the electrostatic latent image is trimmed, and the trimmed electrostatic latent image is supplied with toner from a developing roller (developing sleeve) 4*a* of the developing device 4. As a result, the electrostatic latent image is visualized as a toner image.

A transfer paper contained in a feed paper cassette (not shown) is fed out, one by one, at a predetermined timing by a feed paper roller. This transfer paper P is temporarily stopped between a resist roller 12 and a pressure roller 13 rotating in contact relation with the resist roller 12, so that a timing adjustment can be made. Thereafter, the transfer paper P is fed toward a transfer portion of the transfer device 7 at a coincident timing with the toner image visualized on the photosensitive body 1. A transfer bias is supplied to the transfer Paper P by a bias roller 7*b* and the upper surface side of the transfer paper P is brought into contact with the surface 1*a* of the photosensitive body 1, so that the toner image is transferred. The transfer paper P is separated away from the surface 1*a* of the photosensitive body 1, then delivered to a fixing device, not shown, and the toner image is then fixed to the transfer paper P by heating. Thereafter, the transfer paper P is discharged to a paper discharge tray or the like. Foreign matters such as toner and paper powder remained on the surface 1*a* of the photosensitive body 1 are removed by 4 cleaning blade 9*a* of the cleaning unit 9 after the completion of transfer. The residual electric potential on the surface 1*a* of the photosensitive body 1 is removed by the quenching lamp 10 so as to be made ready for the next charging by the charging roller 2. This sequence of processes for making an image is repeated.

Figure 2:
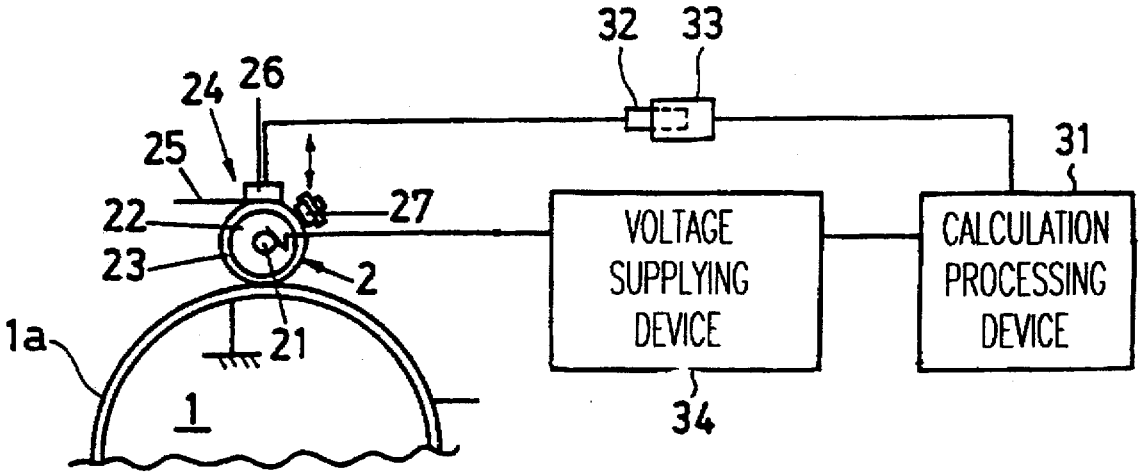
FIG. 2 is a schematic view showing an important portion, as well as a control system, of the above.

FIG. 2 is a schematic view showing a correlation among the charging member 9, the photosensitive body 1 and the voltage control means according to the present invention.

In FIG. 2, the charging roller 2 here has an outer diameter of 14 mm. This charging roller 2 has a conductive core 21 made of iron or the like. The charging roller 2 further has an elastic layer 22 made of an epichlorohydrine rubber. The elastic layer 22 is disposed outside the conductive core 21. This surface layer 23 is formed on an outer peripheral surface of the elastic layer 22. This surface layer 23 is formed by applying a coating material onto the outer periphery of the elastic layer 22. The coating material is obtained by dispersant a hydrine rubber into a solvent called lumifron. The charging roller 2 is caused to contact the photosensitive body 1 under a pressure, for example, of its dead weight (about 200 g) plus a single side of 260 gf (gram weight).

Figure 8:
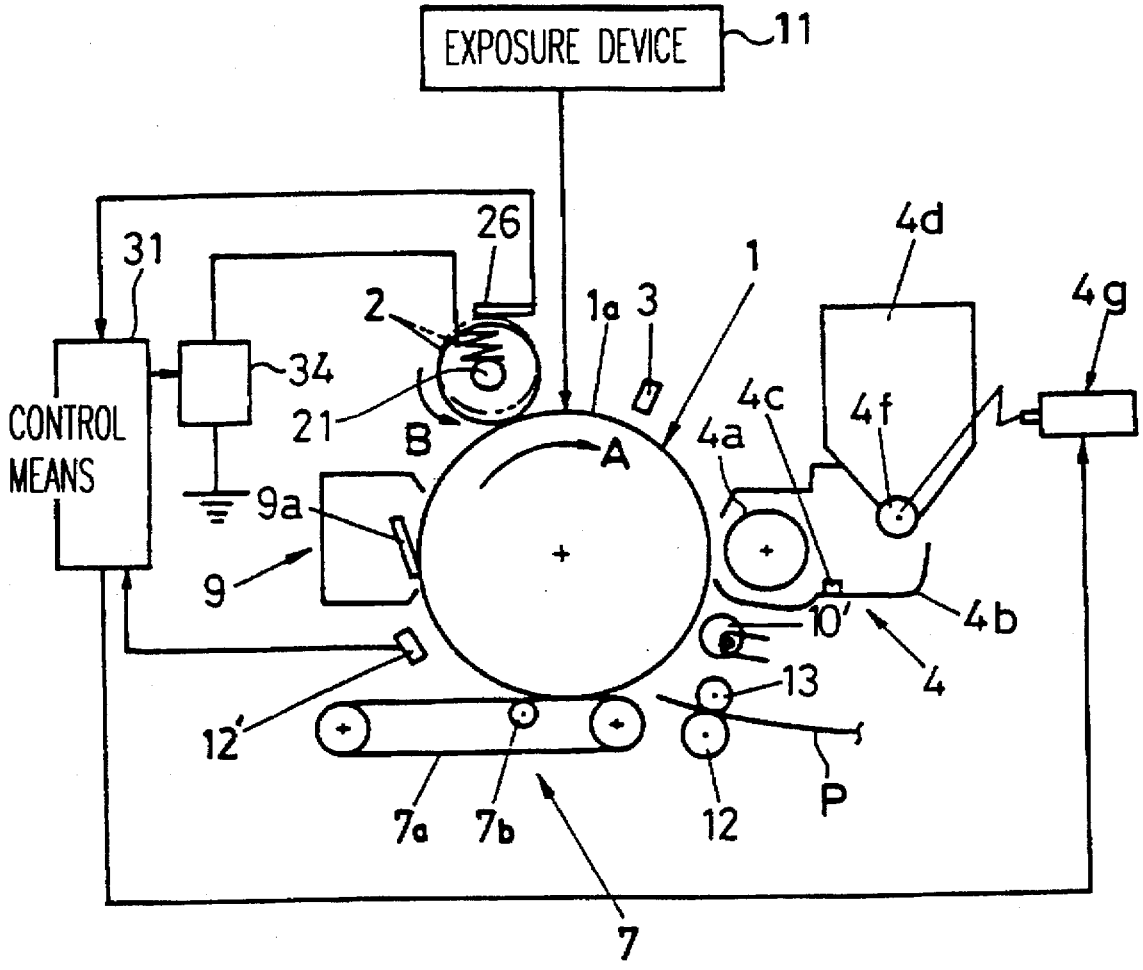
FIG. 8 is a schematic view showing a general construction of an image forming portion and a control system of a copying machine according to a second embodiment of the present invention.

Reference numeral 24 denotes a temperature detection means. This temperature detector has a thermistor 20 secured to a distal end portion of a conductive leaf spring 25. The thermistor 26 is in contact with the surface of the charging roller 2 through a film, not shown. A detecting output of the thermistor 28 is input to a calculation processing means 31 through a connecting terminal 32 and a connector 33. Reference numeral 27 denotes a cleaning member. This cleaning member 27 is usually separated from the charging roller 2. The cleaning member 27 is brought into contact with the charging roller 2 at a predetermined timing by a driving device, not shown, when the calculating operation of the calculation processing means 31 is undergoing. The charging roller 2 and the temperature detection scans 24 are integrated to form a charging unit as shown in FIG. 8. The charging unit has a connecting terminal 32 to which the thermistor 26 is connected. The connecting terminal 32 is inserted into a connector 33 (see FIG. 2) on the side of the copying machine body on which the calculation processing means 31 is loaded. The charging unit is attachable and detachable with respect to a copying machine body. The thermistor 26 and the calculation processing means 31 are electrically connected through the connector 33. The calculation processing means 31 is a general purpose microcomputer. This microcomputer generally controls each part in the copying machine. The calculation processing means 31 acts as a voltage control means (detection temperature read means, voltage calculation means and voltage maintaining means) as later described in detail.

Reference numeral 34 denotes a voltage supplying device. The voltage supplying device 34 supplies a voltage to the conductive core 21 of the charging roller 2 at a predetermined timing. By doing this, the surface 1*a* of the photosensitive body 1 is charged. FIG. 4 shows a relation between a detection temperature detected by the temperature detection means 24 and an amount of correction of the supply voltage to be supplied to the charging roller 2 when the surface 1*a* of the photosensitive body 1 is charged to −900 V. Data showing this correcting relation are stored in the ROM of the calculation processing means 31 as a correction table.

The calculation processing means 31 counts the integrating rotation time of the photosensitive body 1 using a timer (counter), not shown. By this, aging difference of wear of the photosensitive layer on the photosensitive body 1, etc, can be measured. This measurement is performed because even if the voltage to be supplied to the charging roller 2 is the same and the temperature of the charging roller 2 is the same, the charged electric potential on the surface 1*a* of the photosensitive body 1*a* is changed by aging change caused by wear, etc. In accordance with the amount of aging change of the photosensitive body 1, the calculation processing means 31 selects a correction rule indicated-by a solid line (or broken line) of FIG. 4. With reference to the selected correction rule, the calculation processing means 31 obtains an amount of correction of the supply voltage to be supplied to the charging roller 2 based an the detection temperature value detected by the temperature detection means 14. The calculation processing means 31 adds this amount of correction to a reference voltage (−1500 V here). The corrected voltage is supplied to the charging roller 2 by the voltage supplying device 34, to that the surface 1*a* of the photosensitive body 1 is charged to −900V.

With respect to an amount of correction of a supply voltage per 1° C. of the detection temperature detected by the temperature detection means 24, in the case of an early stage correction. there are three sorts of corrections −60 V, −25 V and −6V in this embodiment, which corrections correspond respectively to a range of from about 10° C. to about 20° C. a range of from about 20° C. to about 30° C. and a range of from about 30° C. to about 40° C. Detailed description of the amount of correction in case of aging change is omitted. In any of the early stage correction and the aging change, the amount of correction for 1° C. is large on the low temperature side. Therefore, in the case where the temperature of the charging roller 2 is read every predetermined time interval by the temperature detection means 24, if the detection temperature data detected by the temperature detection means 24 last time (preceding time) and the detection temperature data detected by the temperature detection means 24 this time exceeds 1° C. due to noise, etc., the calculation processing means 31 corrects the supply voltage with an amount of correction greatly different from an amount of correction corresponding to an actual temperature when the last time temperature (actual temperature) of the charging roller 2 in a low temperature (for example, 10° C. to 20° C.). As a consequence, density of the image transferred onto the transfer paper is fluctuated.

In case the detection temperature of the charging roller 2 detected by the temperature detection meant 24 is read in an extremely short time interval, it cannot be contemplated that a difference between the temperature of the charging roller 2 measured last time and the temperature of the charging roller 2 measured this time becomes extremely large. That is, a difference between the temperature measured last time and the temperature measured this time is considered to be sufficiently smaller than 1° C. When a difference between the temperature of the charging roller 2 measured last time and the temperature of the charging roller 2 measured this time is within 1° C., admixture of some noise to the detection temperature data can be considered to hardly affect the density of the image to be transferred onto a transfer paper.

Figure 5:
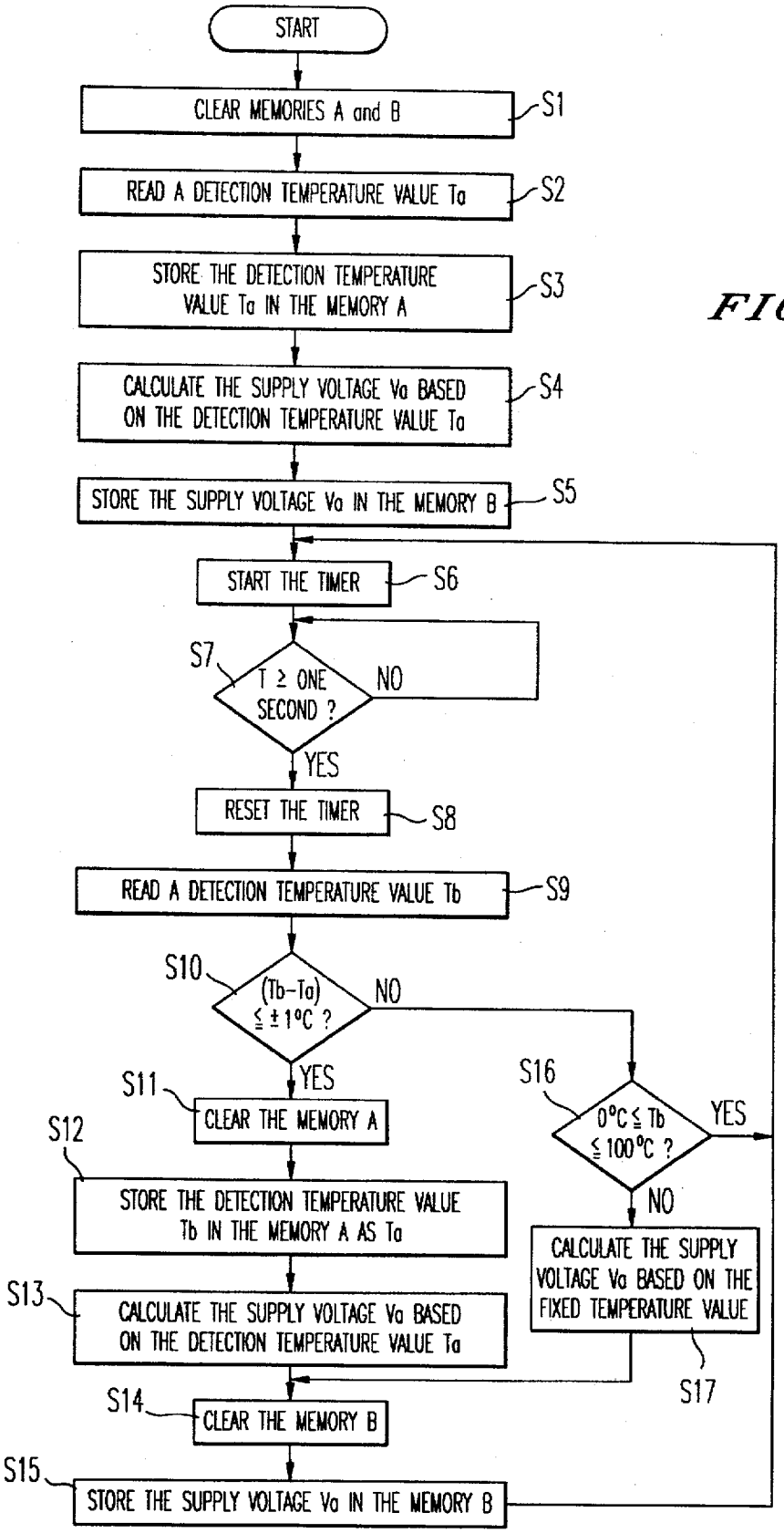
FIG. 5 is a flow chart showing one example of a procedure for setting a detection temperature which is to be executed by a calculation device of FIG. 2.

In view of the above, in the copying machine according to the present invention, the procedure shown in FIG. 5 is executed so that fluctuation of an image caused by noise during the reading of the detection data can be restrained.

In FIG. 5, when a main switch (not shown) is turned on, the calculation processing means 31 clears memories A and B not shown (step S1). Then, the calculation processing means S1 reads a first detection temperature value Ta detected by the temperature detection means 24 (step S2). The detection temperature value Ta is stored In the memory A (step S3), and the calculation processing means 31 calculates the supply voltage Va to be supplied to the charging roller 2 based on the detection temperature value Ta (step S4). That is, the calculation processing means 31 selects the correction rule indicated by a solid line (or broken line) of FIG. 4 in accordance with the amount of aging change of the photosensitive body 1, then obtains an amount of correction of the supply voltage to be supplied to the charging roller 2 based on the detection temperature value Ta with reference to the selected correction rule, and then adds the same to the reference voltage (−1500 V) to calculate the supply voltage Va to be supplied to the charging roller 2. The supply voltage Va in stored in the memory B. The calculation processing means 31 then causes the timer to start (step S6) and judges whether or not the count time t counted by the timer has passed one second (step S7). If the judgment result is negative, the procedure of step S7 is repeated and if the judgment result is affirmative, the timer is reset (step S8). Then, the process proceeds to the step S9 where the calculation processing means 31 reads a time detection temperature value Tb (detection temperature value Tb detected this time) which is detected second time or thereafter. Subsequently, the calculation processing means 31 judges whether or not a difference between the detection temperature value Tb detected this time and the detection temperature value Ta detected last time and stored in the memory A is equal to or lower than a preset temperature value (Tb−Ta≦±1° C.) (step S10). If the difference between the detection temperature value Tb and the detection temperature value Ta is equal to or lower than the preset temperature value 1° C. the memory A is cleared (step S11), and the detection temperature value Tb read this time is stored in the memory A as the detection temperature value Ta (step S12). Thereafter, the supply voltage Va to be supplied to the charging roller 2 is calculated based on this detection temperature value Ta (step S13), then the memory B is cleared (step S14), then the supply voltage Ta is stored in the memory 1, and then the process returns to the step S6. That is, if the difference between the last time detection temperature value and this time detection temperature value is within 1° C. when the detection temperature value is read every one second, it is considered that the temperature of the charging roller 2 has naturally changed and it is also considered that the noise, if any, hardly affects the fluctuation of the image density. Therefore, the supply voltage is supplied to the charging roller 2 based on an amount of correction calculated based on this time detection temperature value.

Then, in the step S10, the calculation processing means 31 judges whether or not the difference between the detection temperature value Tb read this time and the detection temperature value Ta read last time exceeds the preset temperature value 1° C. and if the judgement result is affirmative, the process proceeds to the stop S16. In the step S16, the calculation processing means 31 judges whether or not the detection temperature value Tb read this time is within the preset temperature range (0° C.≦Tb≦100° C.). If the detection temperature value Tb read this time is within the preset temperature range (0° C.≦Tb≦100° C.), the process proceeds to the step S6. Then, the procedure of the steps S6 to S10 is repeated. That is, when the detection temperature value Tb is within the predetermined temperature range and the difference between the detection temperature value Tb and the detection temperature value Ta exceeds 1° C. it is regarded that noise is admixed to the detection temperature value Tb read this time. In this case, the supply voltage calculated based on the detection temperature value Ta read last time is continuously supplied to the charging roller 2. The calculation processing means 31 functions as detection temperature read means for reading the value of the detection temperature detected by the temperature detection means 24, voltage calculation means for calculating a supply voltage to be supplied to the charging member based on the detection temperature value read by the detection temperature read means, and maintaining means for maintaining the supply voltage calculated last time as it is when the difference between the detection temperature value read this time and the detection temperature value read last time exceeds the preset temperature value.

When the detection temperature value Tb is not within the preset temperature range (0° C.≦Tb≦100° C.), it is regarded that a wire-cut or short circuit has occurred in some place of a connecting line between the connecting terminal 32 and the connector 33. In this case, the calculation processing means 31 regards a predetermined fixed temperature value as the detection temperature and calculates the supply voltage Va to be supplied to the charging roller 2 based on the fixed temperature value. Then, the process proceeds to the step S14.

Figure 6:
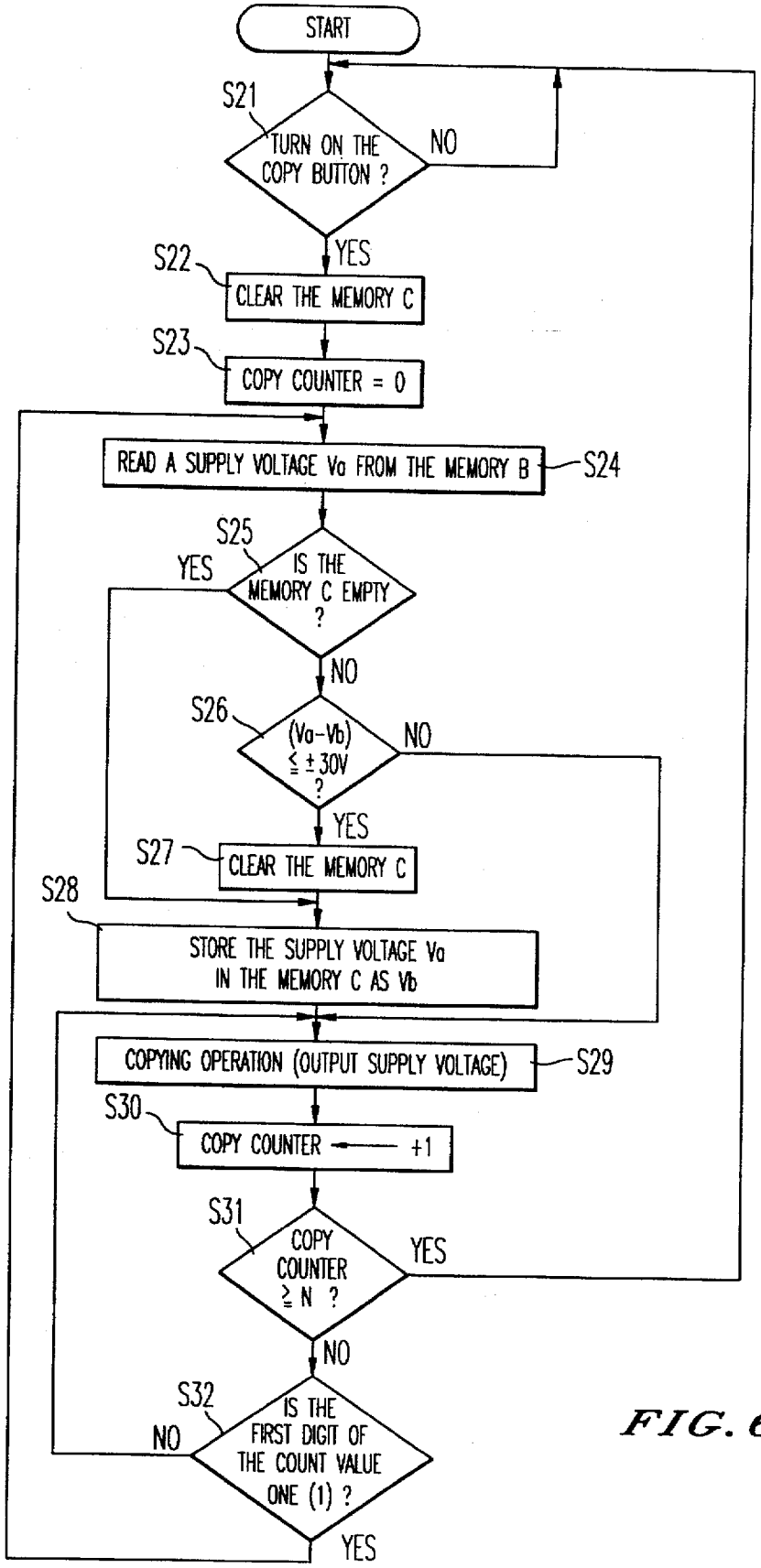
FIG. 6 is likewise a flow chart showing another example of a procedure for setting a detection temperature according to the present invention.

When the main switch is turned on, the calculation processing means 31 executes the procedure shown in FIG. 6 simultaneously with the procedure shown in FIG. 5.

A person engaging in a copying work repeatedly sets the number of required copies (setting number) for each original image and depresses a copy button. The calculation processing means 31 judges whether or not the copy button is turned on (step S21). If the judgment result is affirmative, a memory C, not shown, is cleared and a copy counter, not shown, is cleared to "O" (steps S22 and S23). The calculation processing means 31 reads the supply voltage Va to be supplied to the charging roller 2 from the memory B (step S24), and then judges whether or not the memory C is empty (step S25). Since the memory C is empty only immediately after the copy button is turned on, the supply voltage Va read from the memory B this time is stored in the memory C as the supply voltage Vb immediately after the copy button is turned on (step S28). Then, a copying operation including an image forming process is carried out (step S29). At that time, the voltage Vb stored in the memory C is supplied to the charging roller 2 by the voltage supplying device 34.

When the memory C is not empty, the process proceeds to the step S26 where it is judged whether or not the difference between this time supply Voltage Va read from the memory B and the supply voltage Vb stored in the memory last time is equal to or lower than a preset voltage value (Va−Vb≦±30 V). If the judgment result is affirmative, the memory C is cleared (step S27). Then, the calculation processing means 31 stores the supply voltage Va read from the memory B this time in the memory C as the supply voltage Vb (step S28). Thereafter, a copying operation including the process for forming an image is carried out. At that time, this supply voltage Vb is supplied to the charging roller 2 by the voltage supplying device 34 (step S29).

On the other hand when the difference between the this time supply voltage Va read from the memory and the last time supply voltage Vb stored in the memory C exceeds the preset voltage value, the process proceeds to the step S29 where the copying operation is carried out. At that time, the supply voltage Vb stored in the memory C last time to supplied again to the charging roller 2.

When a copying operation of a single transfer paper P is carried out, the copy counter is incremented (+1) (step S30), and the calculation processing means 31 judges whether or not the integrating copy number (count value) has reached the preset number (step S31). When the judgment result is affirmative, the process returns to the step S21. In contrast, when the judgment result is negative, the process proceeds to the step S32. In the step S32, the calculation processing means 31 judges whether or not the first place or digit of the integrating copy number by the copy counter is "O". This is made in order to judge whether or not the repeat copy number after the renewal of the supply voltage Vb has reached ten. When the first place or digit of the integrating copy number is not "O" the process returns to the step S28 where a copying operation is carried out again. In contrast, when the first place or digit of the integrating copy number in "O" the process returns to the stop S24 where the supply voltage Va is read again from the memory.

Figure 7:
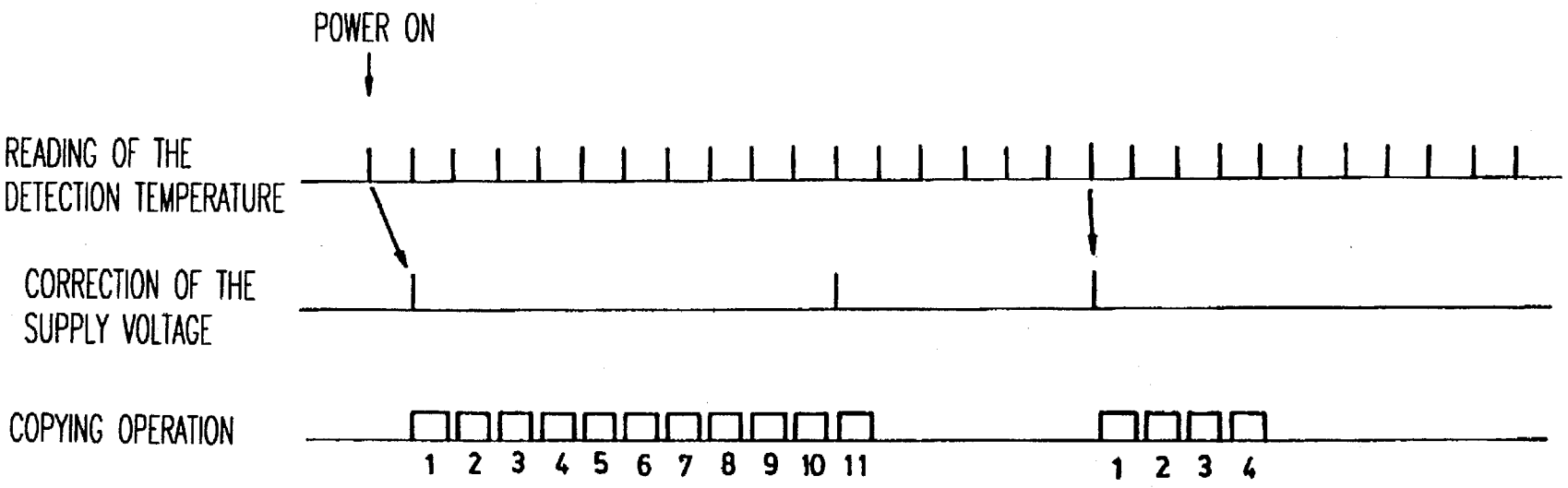
FIG. 7 is a timing chart showing the timing for reading a detection temperature value detected by a temperature detection portion and the timing for correcting a supply current to be supplied to the charging roller in accordance with the detection temperature value, when a copying operation for taking eleven repeat copies and a copying operation for taking four repeat copies are undergoing.

That is, in this copying machine, when an image is to be formed continuously on plural sheets of paper, the change of the supply voltage Va is made every ten sheets of paper. Therefore, in order not to change the supply voltage to be supplied to the charging roller 2 during rotation of the photosensitive body which rotation for obtaining an electrostatic latent image to be formed on a single transfer paper P, the supply voltage obtained based on the result of calculation of the voltage calculation means is switched at a predetermined timing immediately after the counting made by the copy counter. For example, FIG. 7 shows a timing chart for explaining the timing for the temperature detection means portion 24 to read the detection temperature value and the switching state of the supply voltage to the charging roller 2 based on the detection temperature value when eleven repeat copies and four repeat copies are taken. When eleven repeat copies are taken, the supply voltage is supplied to the charging roller 2 at a predetermined timing every ten sheets. When the number of repeat copies is nine or less, the times for making a correction of the supply voltage is only once. This supply voltage is supplied to the charging roller 2 at the start of the process for forming an image.

Here, when the difference between this time supply voltage Va and last tine supply voltage Vb is larger then the preset voltage value, the last time supply voltage Vb is supplied to the charging roller 2. The reason is that owing to this arrangement, an image fluctuation can be prevented as much as possible during the time the repeat copies are taken. In this embodiment, the procedure for reading the detection temperature value detected by the temperature detection means 24 every one second and correcting the supply voltage to be supplied to the charging roller 2 based on the detection temperature value is executed every repeat copying operation. However, the time interval for reading the detection temperature value and the time interval for correcting the supply voltage to be supplied to the charging roller 2 may be changed.

In this first embodiment, the present invention is described in the form of a copying machine. However, the present invention is not limited to this but it can be likewise applied to optical printers such as laser printers, LED printers and liquid crystal printers, as well as other electrophotographic image forming apparatus such as facsimile machine.

Second Embodiment

FIG. 8 is a schematic view showing a general construction of an image forming portion and a control system of a copying machine according to a second embodiment of the present invention. For the purpose of a space saving of an apparatus body, an organic photosensitive body having an outer diameter of 60 mm is used as an organic body 1 of this copying machine. Here, a charging roller 2 can be brought toward and away from a surface 1*a* of the photosensitive body 1. The charging roller 2 is in contact with the surface of the photosensitive body 1 by a biasing force of a spring, not shown, under a contact pressure of, for example, 10 g/cm (generally line contact). Around the photosensitive body 1, there are arranged, in addition to the charging roller 2, an eraser 3, a developing device 4, a transfer device 7, a P-sensor 8, and a cleaning unit 9 as in the case with the first embodiment. It should be noted that in this copying machine, a before-transfer quenching lamp 10' is disposed between the developing device 4 and the transfer device 7.

Here, a P-sensor 12' comprising a reflection type photosensor is disposed between the transfer device 7 and the cleaning unit 8. This P-sensor 12' comprises a light emitting portion and a light receiving portion. The P-sensor 12' has the function for detecting the toner density on the photosensitive layer 1*a* on the photosensitive body 1. The procedure for detecting a toner density using the P-sensor 12' is separately executed from an actual copying operation. A density detecting P-pattern is formed beside a contact glass at an upper portion of the copying machine. This P-pattern is located below a side scale, not shown. In this copying machine, the P-pattern (for example, of a size of about 20 cm×20 cm) is formed on the photosensitive layer 1*a* on the photosensitive body 1 every time, for example, ten copies are finished. Since this P-pattern is formed in an area outside an image forming area where an image in usually formed, no adverse affect is rendered to the copy. The P-pattern is formed into a toner image developed by the developing device 6. The toner image passes directly through the transfer device 7 and reaches the P-sensor 12'. In the P-sensor 12', its light emitting portion emits an emission light toward the P-pattern and its light receiving portion receives a reflected light from the P-pattern. The P-sensor 12' detects the toner density (amount of toner adhesion) in accordance with intensity of the reflected light. This P-pattern is erased after the detection of density. An electrostatic latent image of an original image is formed in the same manner as the first embodiment. The electrostatic latent image is visualized using a two component developing agent obtained by mixing a carrier (developing agent) and a toner.

The developing device 4 has a magnetic permeability sensor 4*c* placed in a developing tank 4*b*. The magnetic permeability sensor 4*c* detects a ratio between the carrier and the toner. A toner replenishing tank 4*d* is attached to the developing tank 4*b* and adapted to replenish a toner into the developing tank 4*b*. The toner contained in the toner replenishing tank 4*d* is replenished to the developing tank 4*b* by means of rotation of a toner replenishing roller 4*f*. When a toner replenishing solenoid 4*g* is turned on, a toner replenishing clutch, not shown, is turned on. As a result, the toner replenishing roller 4*f* is rotated. The transfer paper P is transferred to the transfer device 7 as in the case with the first embodiment. As in the case with the first embodiment, a bias roller 7*b* is in contact with the back side of an endless belt 7*a* disposed between metal rollers of the transfer device 7 and adapted to supply a transfer bias to the transfer paper P. The procedure for transferring and fixing a toner image onto the transfer paper P is the same as the first embodiment. It should be noted that in this transfer device 7, there is employed a constant current system in which a current supplied to the photosensitive body 1 is maintained to be constant.

Operation of the quenching unit 9 is the same as the first embodiment, and electricity is removed by the quenching lamp (not shown in FIG. 8).

Figure 9:
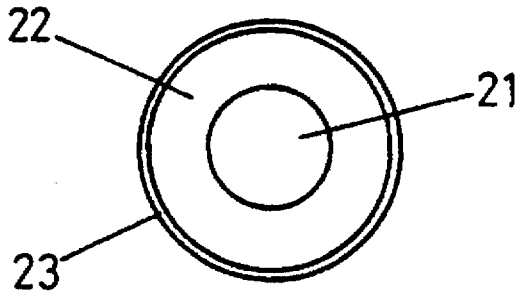
FIG. 9 is an enlarged side view showing a construction of the charging roller of FIG. 8.
Figure 10:
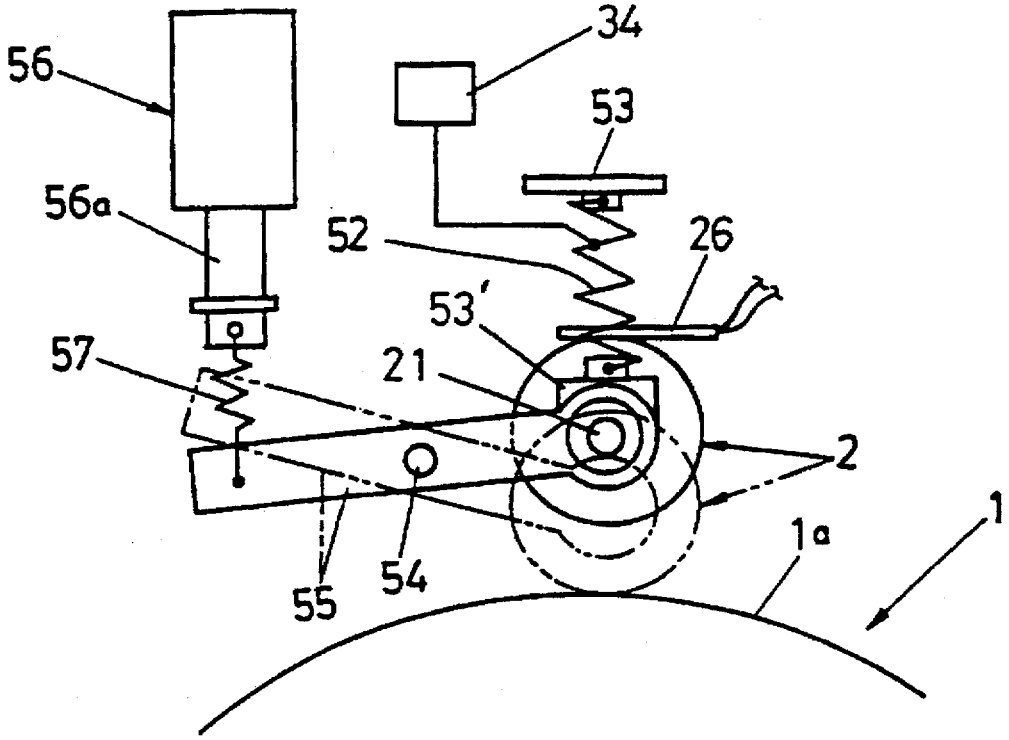
FIG. 10 is a schematic view showing a general construction of a contacting/separating mechanism for bringing the charging roller into contact with a photosensitive body and separating the charging roller away from the photosensitive body.

An outer diameter of a conductive core 21 of the charging roller 2 shown in FIG. 9 is 8 mm in this second embodiment. An elastic layer 22 of the charging roller 2 comprises an epichlorohydrine rubber having a thickness of 3 mm. This elastic layer 22 constitutes a conductive rubber roller portion having an outer contour of 14 mm. A surface layer 23 is made of a material obtained by admixing a hydrine rubber, a fluorine-contained resin and a silica. Opposite ends of the core 21 are rotatably carried on bearings 53' as shown in FIG. 10. Each bearing 53' is normally biased in a direction away from the photosensitive body 1 by a tension bias spring 52. When the photosensitive body 1 is not required to be charged, the charging roller 2 is kept away from the photosensitive body 1 by a biasing force of the tension bias spring 52 as indicated by a solid line in FIG. 10. Reference numeral 53 denotes a fixing member made of an insulating material. One end of the tension bias spring 52 is retained by this fixing member.

A minus supply voltage is supplied from a voltage supplying device 34 as a high pressure power source generating circuit to the charging roller 2 through the tension bias spring 52 and bearings 53', so that the photosensitive layer 1*a* of the photosensitive body 1 is charged to −900 V as in the case with the first embodiment. The bearing 53' is attached to one end of an arm 55 whose generally central portion is swingably supported by a shaft 54. In this second embodiment, the charging roller 2 is rotatably supported through the bearing 53'. A movable shaft 56*a* of a solenoid 56 is attached to the other end of the arm 56 through a spring 57.

A body of the solenoid 56 is secured to the apparatus body. When the solenoid 56 is in the OFF-state, the other end of the arm 55 is located in a position as indicated by a solid line of FIG. 10 under the effect of the tension bias spring 52, and the charging roller 2 is in its standby state away from the photosensitive body 1. When the solenoid 56 is turned on, the other end of the arm 65 is swung clockwise against the tension bias of the tension bias spring 52 and brought to a position as indicated by an imaginary line.

Above the charging roller 2, a thermistor 26 acting as a temperature detection means 24 is disposed in proximate relation to the charging roller 2 as in the case with the first embodiment. In this second embodiment, when the charging roller 2 and the photosensitive body 1 are located away from each other, the thermistor 26 is in contact with the surface of the charging roller 2 in order to detect the surface temperature of the charging roller 2. When the charging roller 2 and the photosensitive body 1 are in contact relation, the thermistor 26 is located away from the charging roller 2. The temperature detection means 24 and the charging device are integrated into a unit construction as in the case with the first embodiment and therefore, can be replaced with respect to the apparatus body as in the case with the first embodiment.

In the second embodiment, as shown in FIG. 8, there is employed a calculation processing means 31. This calculation processing means 31 controls the various kinds of operations required for copying operation of the entire copying machine and in addition, controls the operation for supplying a supply voltage to the charging roller 2. At that time, when a detection output from the thermistor 28 is not within a preset range, the calculation processing means 31 controls such that a preset supply voltage is supplied to the charging roller 2 irrespective of the detection output.

The calculation processing means 31 comprises a central processing unit (CPU) having various kinds of judging and processing functions, a processing program including a supply voltage controlling program, a ROM for storing therein a fixed data, a RAM for storing therein a processing data, and an input/output circuit (I/O). This calculation processing means 31 comprises a microcomputer as in the case with the first embodiment.

When a detection temperature Ta is within a predetermined range of, for example, (0° C.<Ta≦100° C.) the calculation processing means 31 controls the supply voltage to be supplied to the charging roller 2 in accordance with a detection output corresponding to the detection temperature Ta such that the surface electric potential of the photosensitive body 1 is brought proximate to a preset value.

Figure 11:
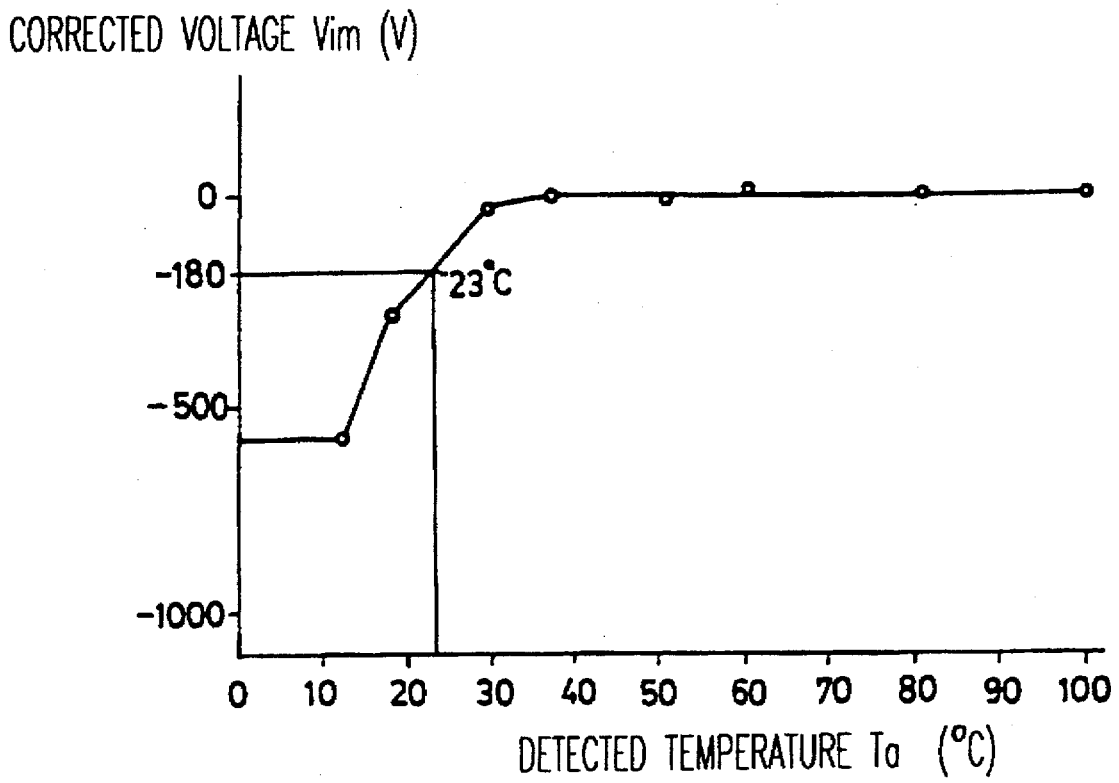
FIG. 11 is a graph showing one example of a relation between a correction voltage for a supply voltage to be supplied to the charging roller and a detection temperature.

The reference supply voltage to be supplied to the charging roller 2 is −1500 V as in the case with the first embodiment. The controlling is made such that the surface electric potential of the photosensitive body 1 is brought proximate to the preset value by applying a temperature-dependent correction voltage Vim to this reference supply voltage. FIG. 11 shows a relation between the correction voltage Vim and each detection temperature Ta at 0° C. to 100° C. The data of the correction voltage Vim with respect to each detection temperature Ta is prestored in the ROM as in the case with the first embodiment.

When the detection temperature Ta is 0° C. or lower, or 100° C. or higher, the calculation processing means 31 switches the toner density controlling mode from a toner density adjusting control mode for changing the amount of replenishing a toner in accordance with the current toner density to a toner quantitative replenishing control mode for maintaining a constant density of toner.

Figure 12:
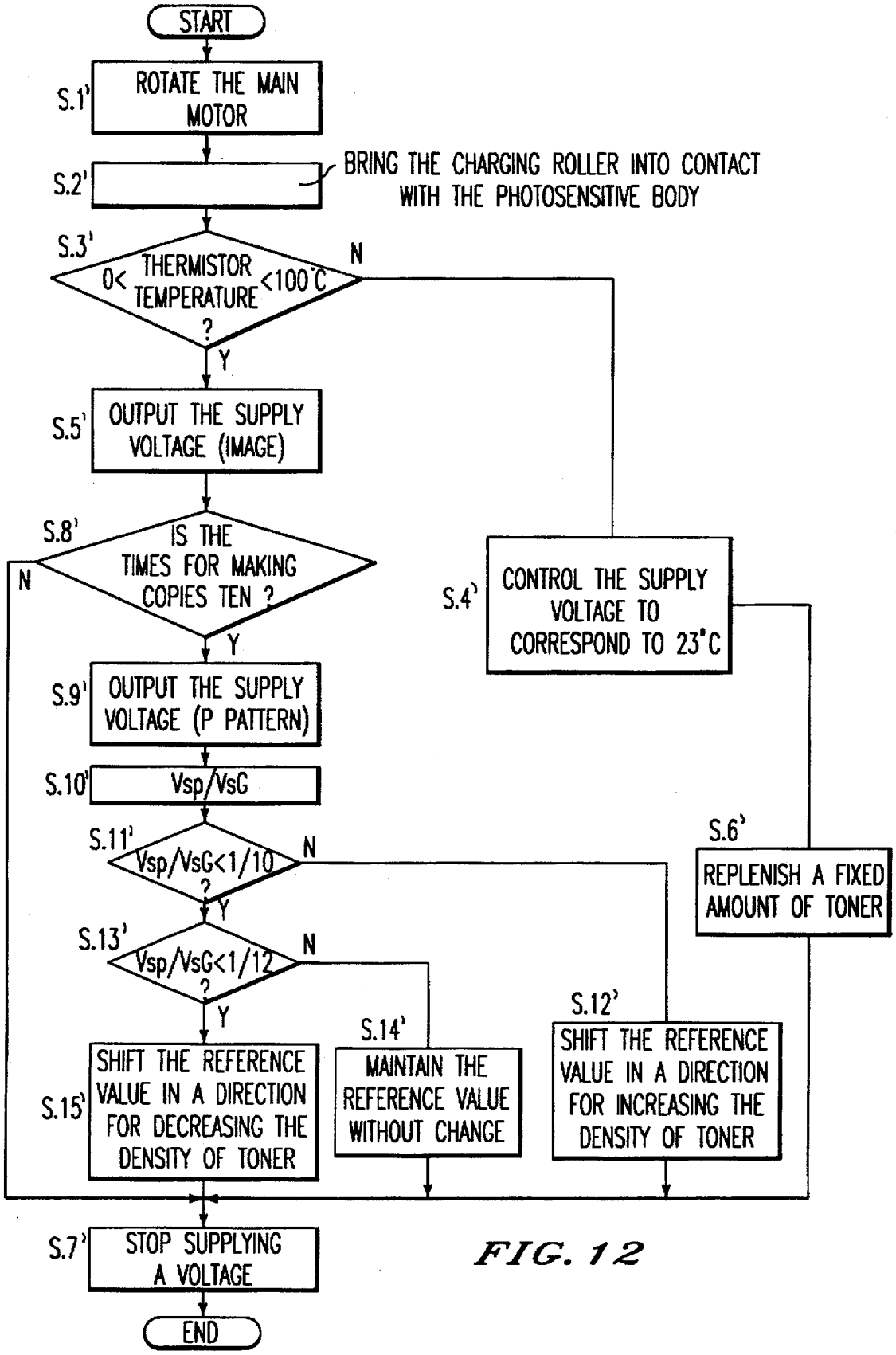
FIG. 12 is a flow chart for explaining a controlling operation made by the calculation means of FIG. 8.

The details will be described with reference to a flow chart of FIG. 12.

When a copy key is depressed, the calculation processing means 31 drives a main motor (not shown) to cause the photosensitive body 1 to be rotated (step 31), and the solenoid 56 is turned on to bring the charging roller 2 into contact with the photosensitive layer 1*a* of the photosensitive body 1 (step 32). Then, the calculation processing means 31 judges whether or not the detection temperature Ta is within the range of from 0° C. to 100° C. (step S3'). At that time, the calculation processing means 31 makes a judgment based on the detection temperature Ta detected immediately before the charging roller 2 is separated away from the thermistor 26. The reason is that when the charging roller 2 is in contact with the photosensitive layer 1*a* of the photosensitive body 1, the charging roller 2 is separated away from the thermistor 26. When the detection temperature Ta is not within the range of from 0° C. to 100° C., the process proceeds to the step S4', and when the detection temperature Ta is within the range of from 0° C. to 100° C., the process proceeds to the step S5'.

In the step S4', the supply voltage V corrected with a correction amount corresponding to a temperature of 23° C. which is ordinarily used is supplied to the charging roller 2. That is, since the correction voltage Vim at the temperature of 23° C. is −180 V, the voltage supplying device 34 is controlled such that a supply voltage obtained by applying this correction voltage to the reference supply voltage of −1500 V, i.e., −1500 V+ (−180) V=−1680 V, is supplied to the charging roller 2. By virtue of this arrangement, it can be avoided that a high voltage close to a breakdown voltage caused by inferior connection of the connector, wire-cut, deterioration of an image due to short circuit, particularly, the high voltage caused by inferior connection and wire-cut, is supplied.

The calculation processing means 31 executes the procedure of the step S6' after the completion of the procedure of the step S4'. In the step S6', toner is replenished (quantitative replenishment) such that an amount of replenishing a toner for each copy corresponds to an image area rate of 4%, for example. That is, the amount of replenishing a toner for each sheet of paper becomes the above-mentioned amount, the solenoid 4*g* is ON/OFF controlled, the toner replenishing roller 4*f* is rotated a predetermined amount, and the toner contained in the toner replenishing tank 4*d* is replenished to the developing tank 4*b*. Then, the supply of a supply voltage to the charging roller 2 is stopped (step S7'). By this, the charging procedure with respect to the photosensitive body 1 is all finished.

In case the detection temperature Ta is within the range of from 0° C. to 100° C., the calculation processing means 31 makes a correction based on a relation between the detection temperature Ta and the replenishing voltage Vim, and controls the supply voltage to be supplied to the charging roller 2 such that the surface electric potential of the photosensitive body 1 is brought proximate to the preset value (step S5'). Then, the calculation processing means 31 judges whether or not the times for making copies is ten (step S8'). When the times for making copies is ten or less, the process proceeds to the step S7' where the reference value corresponding to the density of toner of the magnetic permeability sensor 4c preset last time is maintained. When the times for making copies is ten, the P-pattern forming supply voltage is supplied to the charging roller 2. This supply voltage may be different from the supply voltage for forming the original image.

Then, the calculation processing means 31 detects a toner adhesion amount VSP of the P-pattern portion onto which a toner is adhered by the developing device 4, and a toner adhesion amount $V_{SP}/V_{SG}$ of the ground portion onto which no toner is adhered. Subsequently, the calculation processing means 31 calculated the ratio $V_{SP}/V_{SG}$ (stop S9'). In the step S11', it is judged whether or not the ratio $V_{SP}/V_{SG}$ is smaller than 1/10 (step S10'). When the ratio $V_{SP}/V_{SG}$ is equal to 1/10 or larger, then the process proceeds to the step S12'. In the step S12', the reference value of the magnetic permeability sensor 4c with respect to the density of toner is shifted in a direction for increasing the density of toner. The reason is that the density of toner in the developing tank 4b is too thin and the replenishment of toner to the developing tank 4b is much more necessary. When the ratio $V_{SP}/V_{SG}$ is smaller than 1/10, it is judged whether or not the ratio $V_{SP}/V_{SG}$ is smaller than 1/12 (step S13'). When the ratio $V_{SP}/V_{SG}$ is equal to 1/12 or larger, the reference value of the magnetic permeability sensor 4c with respect to the density of toner is maintained (step S14'). The reason is that the density of toner in the developing tank 4b is proper. When the ratio $V_{SP}/V_{SG}$ is smaller than 1/12, the reference value or the magnetic permeability sensor 21 with respect to the density of toner is shifted in a direction for decreasing the density of toner (step S15'). The reason is that since the density of toner in the developing tank 4b is too thick, it is necessary to decrease the replenishing amount of toner to the developing tank 4b. In this second embodiment, the supply voltage to be supplied to the charging roller 2 and the density of toner in the developing tank 4 are controlled. Here, when a copy job for a single transfer paper P is finished, the charging roller 2 is separated away from the photosensitive body 1 and brought into contact with the thermistor 26. By this, the calculation processing means 31 renews its memory with respect to the surface temperature Ta.

When the detection temperature Ta is changed from a value not within the range of from 0° C. to 100° C. to a value within the range, the calculation processing means 31 controls again in accordance with the detection output of the thermistor 26 such that the surface electric potential of the photosensitive body 1 is brought proximate to the preset value. Owing to this arrangement, even when something abnormal occurs to the detection output of the thermistor 26, the user itself or the service man can remove the cause of abnormality simply by replacing the charging device of the unit construction incorporated with the thermistor 26. Accordingly, an easy maintenance can be obtained. Similarly, when the detection temperature Ta is changed from a value not within the range of from 0° C. to 100° C. to a value within the range, the calculation processing means 31 switches the control mode again from the toner quantitative replenishing control mode to the toner density adjusting control mode. Owing to this feature, a toner density adjusting control for changing the replenishing amount of toner in accordance with the current toner density can be carried out simply by replacing the charging device. In case the thermistor 26 alone is out of order and the charging device is still within its service life, it can be possible that only the thermistor 26 is replaced by a new one and the charging device is kept using. If it is arranged such that the thermistor 26 is in non-contact relation with the surface of the charging roller 2, the charging roller 2 can be prevented from being damaged by the thermistor 26. A constant toner density control system may be employed instead of the toner quantitative replenishing control system.

What is claimed is:

1. An image forming apparatus comprising a charging member to be contacted with a rotating photosensitive body so as to charge said photosensitive body, temperature detection means for detecting temperature of said charging member, and voltage control means for controlling a voltage to be supplied to said charging member in accordance with a temperature value detected by said temperature detection means, said voltage control means including detection temperature read means for reading the detection temperature value detected by said temperature detection means, voltage calculation means for calculating a voltage to be supplied to said charging member based on the detection temperature value read by said detection temperature read means, and maintenance means for maintaining a charging voltage as it is, which charging voltage is calculated last time, when a difference between the detection temperature value currently read by said detection temperature read means and the detection temperature value which is read last time by said detection temperature read means has exceeded a preset temperature value.

2. An image forming apparatus according to claim 1, wherein said voltage control means includes a voltage switch means for switching the charging voltage obtained based on the result of calculation achieved by said voltage calculation means at a predetermined timing, so that the supply voltage to be supplied to said charging member is not changed during rotation of said photosensitive body which rotation is made for obtaining an electrostatic latent image to be formed on a sheet of paper.

3. An image forming apparatus according to claim 2, wherein said voltage calculation means calculates a supply voltage to be supplied to said charging member based on a predetermined fixed temperature value when said detection temperature value is not within a predetermined temperature range.

4. An image forming apparatus according to claim 2, wherein said voltage control means supplies the supply voltage newly calculated by said voltage calculation means to said charging member at the timing when an image is successively formed on plural sheets of paper.

5. An image forming apparatus according to claim 4, wherein said voltage control means supplies the supply voltage, which was calculated last time, to said charging member when a difference between the supply voltage newly calculated by said voltage calculation means this time and the supply voltage calculated by said voltage calculation means last time exceeds a preset voltage value.

6. An image forming apparatus comprising a charging member to be contacted with a rotating photosensitive body so as to charge said photosensitive body, temperature detection means for detecting temperature of said charging member, and voltage control means for controlling a voltage to be supplied to said charging member in accordance with a temperature value detected by said temperature detection means, said voltage control means including detection temperature read means for reading the detection temperature value detected by said temperature detection means, voltage calculation means for calculating a voltage to be supplied to said charging member based on the detection temperature value read by said detection temperature read means, and maintenance means for maintaining a charging voltage as it is, which charging voltage is calculated last time, when a difference between the detection temperature value currently read by said detection temperature read means and the detection temperature value which is read last time by said detection temperature read means has exceeded a preset temperature value and the detection temperature value is within a predetermined temperature range.

7. An image forming apparatus according to claim 6, wherein said voltage control means includes a voltage switch means for switching the charging voltage obtained based on the result of calculation achieved by said voltage calculation means at predetermined timing, so that the supply voltage to be supplied to said charging member is not changed during rotation of said photosensitive body which rotation is made for obtaining an electrostatic latent image to be formed on a sheet of paper.

8. An image forming apparatus according to claim 6 or 7, wherein said voltage calculation means calculates a supply voltage to be supplied to said charging member based on a predetermined fixed temperature value when said detection temperature value is not within a predetermined temperature range.

9. An image forming apparatus according to claim 7, wherein said voltage control means supplies the supply voltage newly calculated by said voltage calculation means to said charging member at the above-mentioned timing when an image is successively formed on plural sheets of paper.

10. An image forming apparatus according to claim 9, wherein said voltage control means supplies the supply voltage, which was calculated last time, to said charging member when a difference between the supply voltage newly calculated by said voltage calculation means this time and the supply voltage calculated by said voltage calculation means last time exceeds a preset voltage value.

11. An image forming apparatus according to claim 1 to 6, wherein said charging member is made chiefly of an epichlorohydrine rubber.

12. An image forming apparatus according to claim 1 or 6, wherein said detection temperature read means reads said detection temperature value at a predetermined time interval.

13. An image forming apparatus comprising:

a charging member which can be brought into contact with and away from a photosensitive layer of a surface of a rotating photosensitive body and which charges the surface of said photosensitive body when said charging member is brought into contact with the said photosensitive layer;

temperature detection means for detecting temperatures of said charging member; and voltage control means for controlling a supply voltage to be supplied to said charging member in accordance with the detection temperature detected by said temperature detection means so that a surface electric potential of said photosensitive body is maintained to a present voltage value before being subjected to exposure for forming an electrostatic latent image, said voltage control means supplying a preset supply voltage to said charging member when the detection temperature value detected by said temperature detection means is not within a preset temperature range, said preset temperature range having a high limit value and a low limit value, said high and low limit values being fixed values and not changed with the passage of time.

14. An image forming apparatus according to claim 13, wherein said voltage control means supplies a supply voltage corresponding to said detection temperature value again to said charging member when said detection temperature value is changed from a value outside the preset temperature range to a value within a preset temperature range.

15. An image forming apparatus according to claim 13, further comprising a two-component developing device using a developer and a toner, and switch means for switching a control mode from a toner density adjustment control mode for changing a supply amount of toner in accordance with the toner density when the detection temperature value detected by said temperature detection means is not within the preset temperature range to a control mode for maintaining the toner density constant irrespective of toner density or to a control mode for controlling the supply amount of toner constant irrespective of toner density.

16. An image forming apparatus according to claim 15, wherein said voltage control means supplies a supply voltage corresponding to said detection temperature value again to said charging member when said detection temperature value is changed from a value outside the preset temperature range to a value within a preset temperature range, and said switch means switches a control mode again to the toner density adjustment control mode for changing a supply amount of toner in accordance with the toner density when the detection temperature value is changed from a value outside the preset temperature range to a value within the preset temperature range.

17. An image forming apparatus according to one of claims 13 to 16, wherein said voltage control means supplies a preset supply voltage to said charging member when the detection temperature value detected by said temperature detection means goes below a lower limit defining a boundary of the preset temperature range on a lower temperature side.

18. An image forming apparatus according to one of claims 13 to 16, wherein the preset supply voltage is determined based on temperature which is normally used.

19. An image forming apparatus according to claim 13, wherein said charging member is separated from the surface of said rotating photosensitive body when a voltage is not applied to the surface thereof.

20. An image forming apparatus comprising:

a charging member which can be brought into contact with a surface of a rotating photosensitive body and which charges the surface of said photosensitive body when said charging member is brought into contact with the surface thereof;

temperature detection means for detecting temperature of said charging member;

voltage control means for controlling a supply voltage to be supplied to said charging member in accordance with the detection temperature detected by said temperature detection means so that a surface electric potential of said photosensitive body is maintained to a preset voltage value before being subjected to exposure for forming an electrostatic latent image, said voltage control means supplying a preset supply voltage to said charging member when the detection temperature value detected by said temperature detection means is not within a preset temperature range; and a two-component developing device using a developer and a toner, and switch means for switching a control mode from a toner density adjustment control mode for changing a supply amount of toner in accordance with the toner density when the detection temperature value detected by said temperature detection means is not within the preset temperature range to a control mode for maintaining the toner density constant irrespective of toner density or to a control mode for controlling the supply amount of toner constant irrespective of toner density.

21. An image forming apparatus according to claim 20, wherein said voltage control means supplies a supply voltage corresponding to said detection temperature value again to said charging member when said detection temperature value is changed from a value outside the preset temperature range to a value within a preset temperature range, and said switch means switches a control mode again to the toner density adjustment control mode for changing a supply amount of toner in accordance with the toner density when the detection temperature value is changed from a value outside the preset temperature range to a value within the preset temperature range.

22. An image forming apparatus according to claim 20 or 21, wherein said voltage control means supplies a preset supply voltage to said charging member when the detection temperature value detected by said temperature detection means goes below a lower limit defining a boundary of the preset temperature range on a lower temperature side.

23. An image forming apparatus according to claims 20 or 21, wherein the preset supply voltage is determined based on a temperature which is normally used.

24. An image forming apparatus according to claim 22, wherein the preset supply voltage is determined based on a temperature which is normally used.

25. An image forming apparatus comprising:

a charging member which can be brought into contact with a surface of a rotating photosensitive body and which charges the surface of said photosensitive body when said charging member is brought into contact with the surface thereof;

temperature detection means for detecting temperature of said charging member; and voltage control means for controlling a supply voltage to be supplied to said charging member in accordance with the detection temperature detected by said temperature detection means so that a surface electric potential of said photo sensitive body is maintained to a preset voltage value before being subjected to exposure for forming an electrostatic latent image, said voltage control means supplying a preset supply voltage to said charging member when the detection temperature value detected by said temperature detection means to not within a preset temperature range;

said preset supply voltage being determined based on temperature which is normally used.

26. An image forming apparatus according to claim 25, wherein said voltage control means supplies a supply voltage corresponding to said detection temperature value again to said charging member when said detection temperature value is changed from a value outside the preset temperature range to a value within a preset temperature range.

* * * * *